United States Patent [19]

Call et al.

[11] 4,278,023

[45] Jul. 14, 1981

[54] DRIVE SYSTEM FOR ENDORSER

[75] Inventors: Daniel D. Call, Northbrook; Mervin W. La Rue, Jr., Barrington, both of Ill.

[73] Assignee: Bell & Howell Company, Chicago, Ill.

[21] Appl. No.: 23,816

[22] Filed: Mar. 26, 1979

[51] Int. Cl.[3] ..... B41F 13/24

[52] U.S. Cl. ..... 101/235; 192/8 R; 74/437

[58] Field of Search ..... 101/233–235; 74/393, 437; 192/8 R, 144, 148

[56] References Cited

U.S. PATENT DOCUMENTS

| | | | |
|---|---|---|---|
| 2,477,105 | 7/1949 | Wildhaber | 74/393 |
| 2,743,671 | 5/1956 | Weber et al. | 101/235 |
| 2,746,312 | 5/1956 | Wood | 74/393 |
| 2,802,416 | 8/1957 | Karkow, Jr. | 101/235 |
| 3,037,447 | 6/1962 | Gonzalez et al. | 101/91 |
| 3,138,098 | 6/1964 | Worth | 101/235 |
| 3,191,526 | 6/1965 | Ross | 101/91 |
| 3,213,696 | 10/1965 | Manley | 74/393 |
| 3,308,753 | 3/1967 | Zenone | 74/393 |
| 3,332,303 | 7/1967 | Daugherty | 74/437 |
| 3,438,323 | 4/1969 | Smitzer et al. | 101/233 |
| 3,765,651 | 10/1973 | Lifferth | 74/437 |
| 3,808,969 | 5/1974 | Pearce | 101/72 |
| 3,918,313 | 11/1975 | Montagnino | 74/437 |
| 3,952,607 | 4/1976 | Ring | 74/393 |
| 4,016,467 | 4/1977 | Hallenbeck | 101/235 |
| 4,023,489 | 5/1977 | Beery | 101/235 |
| 4,093,056 | 6/1978 | Burgers | 101/235 |

*Primary Examiner*—William Pieprz

*Attorney, Agent, or Firm*—Alan B. Samlan

[57] ABSTRACT

A method and apparatus for a drive system having an intermittently rotating output shaft. In operation, the output shaft is caused to accelerate to a constant rotational velocity, held at that velocity for a predetermined portion of its rotation, then decelerated to zero velocity. The acceleration and deceleration values are caused to be low in magnitude so that components of the system are subjected to reduced shock loadings and generate reduced noise as compared to a rapid acceleration and deceleration system. Particular applicability for the system is found in document endorsers having an endorsing plate connected to the output shaft and rotated such that the endorsing plate contacts and imprints documents in an endorsing area on command.

2 Claims, 8 Drawing Figures

DRIVE SYSTEM FOR ENDORSER

BACKGROUND OF THE INVENTION

Document endorsers or imprinters find particular utility in financial institutions. For example, it is desirable to imprint the backside of checks as they are processed to indicate such things as the date, institution name and number, guaranteed endorsements, etc. Generally, it is desirable to microfilm all checks that a financial institution processes. The endorsement is normally added to the check after both sides are microfilmed. An example of a rotary microfilm recorder is illustrated in U.S. Ser. No. 955,,666 filed Nov. 27, 1978 and assigned to the assignee of the present invention. Other information in addition to an endorsement can be placed on the document and such document imprinting would only be limited by the size limitations of the document and endorsing plate.

There are essentially two types of rotary endorsers, a continuous endorser and an intermittent endorser. As its name implies, a continuous endorser is one in which the endorsing die is continuously rotating. An intermittent endorser is one in which the endorsing die operates only when a document is in position to be endorsed.

One problem with the continuous endorser is that the endorsing die is continuously rotating and receiving ink from an ink roller. Some of this ink is transferred to a backing roller which is located on the other side of the document as the document passes through the endorsing area. As the document passes between the endorsing die and the backing roller, streaks or blobs of ink are transferred from the backing roller to the opposite side of the document that is to be endorsed.

Another problem in a continuous endorsing system is that the endorser and its associated drive are continually subject to wear regardless of whether documents are being endorsed or not. Also, the location or positioning of the endorsement on the document is randomly achieved with adjustments not being possible.

Intermittent endorsers which have been available substantially reduced the severity of the above problems but have their own inherent shortcomings. For example, the parts of the endorser are subject to shock or impact loading each time the endorser is started and stopped which tends to shorten the life of the components. Further, the sudden stopping and starting results in a very noisy operative system.

There is, thus, a need to overcome the inherent noise and wear problems due to shock loading so that the advantages of an intermittent endorser can be utilized. The intermittent system can position the location of the endorsement and is an inherently cleaner operative system in that ink is not continuously being applied to the endorsing die.

SUMMARY

It is thus, an object of the present invention to provide an intermittent drive system for a rotary endorser which is quiet in its operation. It is a further object to provide an intermittent drive system having reduced shock loading as compared to an intermittent drive system having instantaneous starting and stopping.

It is a further object of the invention to provide an intermittent drive system which is economical to manufacture and operate. Yet another object is to provide a drive system which has the flexibility of positioning the endorsement on the document relative to the leading edge of the document.

The present invention comprises a method and apparatus for providing an intermittent endorser which is quiet in operation and avoids shock loading each time the endorser is started and stopped. The present invention discloses an endorsing drive system in which accelerations and decelerations are held to relatively low values by increasing the accelerating time period.

The endorser drive system comprises a constantly rotating input gear connected to a clutch. As a document passes through the endorsing area, it triggers a switch which releases a latching mechanism which allows the clutch output member to rotate for one revolution. The clutch output member has a rounded protrusion on its surface which accelerates a cam arm attached to an endorsing die shaft. The endorsing die is connected to this shaft which is accelerated by the rounded protrusion contacting and driving the cam arm. Appropriate shaping of the cam arm surface allows low acceleration magnitudes.

After the endorsing die is accelerated to a predetermined speed, which is substantially equal to the speed of the document in the endorsing area, a gear drive continues to rotate the endorsing die at this speed. The constant speed is maintained for at least the time period it takes for the document to be endorsed. The endorsing die is then decelerated from the endorsing speed until stopped by a similar means as used to accelerate the die, i.e., a second rounded protrusion on the surface of the clutch output member contacting a second cam arm attached to the endorsing die shaft.

Thus, an intermittent drive system is provided which smoothly accelerates and decelerates the endorsing die. This results in a quietly operating endorsing system with minimum wear on the components as compared to presently available endorsing systems.

DESCRIPTION OF THE PREFERRED EMBODIMENT

The intermittent drive system for a rotary endorser was incorporated in the rotary microfilm camera described in copending U.S. Patent Application Ser. No. 955,666, filed Oct. 27, 1978 entitled Optical System for Rotary Camera and incorporated herein by reference.

Figures 1, 4:
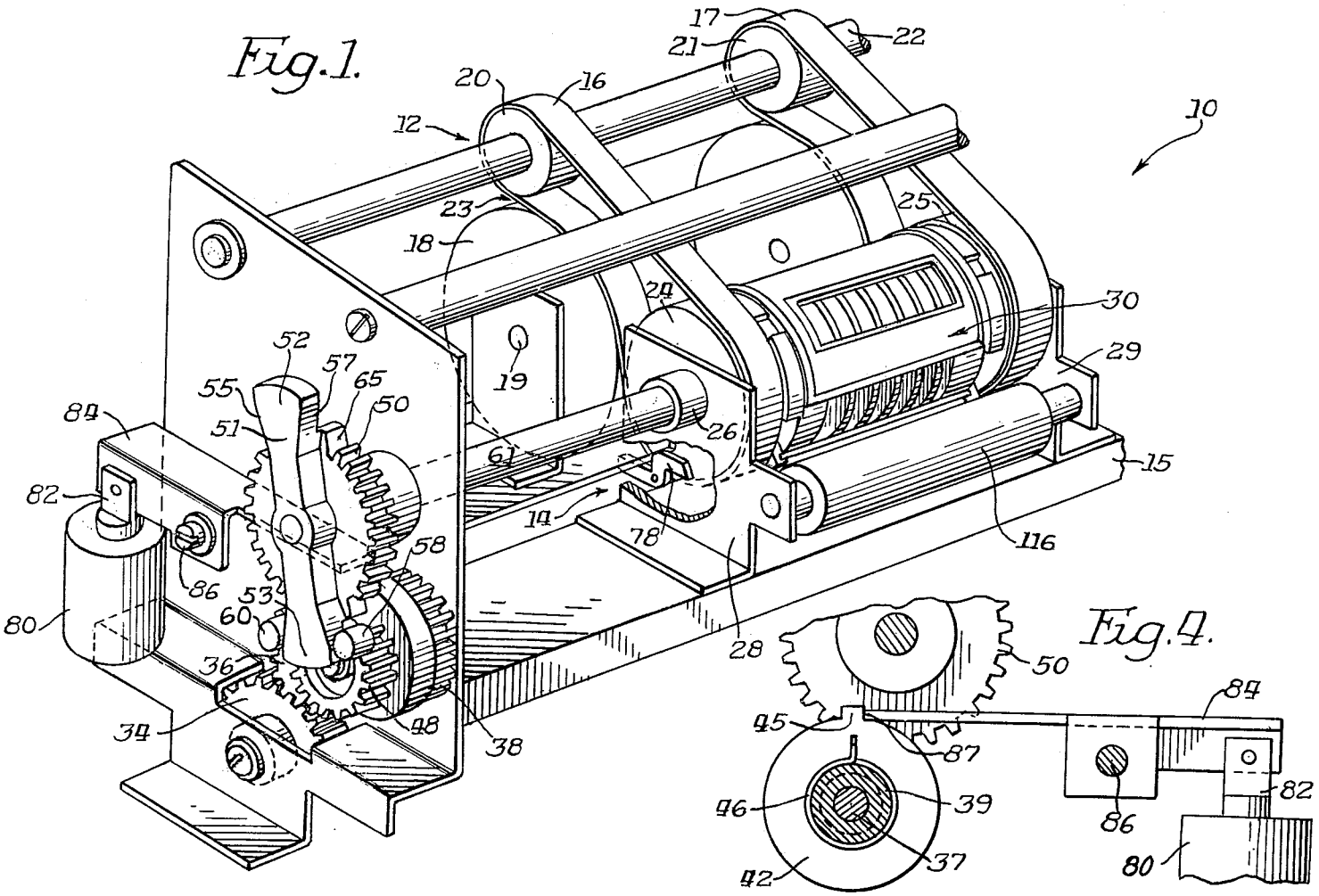
FIG. 1 is a front perspective view of an endorser with the intermittent drive system of the present invention.
FIG. 4 is a side view taken along line 4—4 of FIG. 3 with portions of the endorser removed for clarity to illustrate the clutch latching means.

Turning first to FIG. 1 there is illustrated an endorser 10 having an upper document transport 12. The documents to be endorsed are vertically aligned in a paper channel 14 which is part of or interfaces with other parts of the whole document transport system. The paper channel 14 is formed by an opening in a base plate 15 on which the upper document transport 12 is mounted.

The document enters the paper channel 14 in a vertical position, being propelled upward from the feeder means used to transport the document through the system. It is then grabbed in the nip between document drive belts 16, 17 and large idler roller 18. The idler roller 18 is allowed to rotate freely about idler shaft 19. The document drive belts 16, 17 rotate about document drive wheels 20, 21 and idler wheels 24, and 25. The drive wheels 20, 21 are driven by belt drive shaft 22 in a direction to transport the documents vertically upward and out an exit nip 23, usually into a hopper (not shown).

The idler wheel 24 is allowed to rotate freely about an endorser shaft 61 by means of a collar or bushing 26 mounted on a support bracket 28. Similarly idler wheel 25 is allowed to freely rotate in support bracket 29 by means of an additional collar or bushing not illustrated. Thus, it can be seen that the document path is up through the paper channel 14, between the drive belt 16, 17 and roller 18, and out the nip 23. This results in a document transport system independent of the endorsing system.

An endorsing die 30 is mounted between the idler wheels 24 and 25 in a fixed spaced relationship to the large idler roller 18. The endorser die 30 is directly connected to the endorser shaft 61 such that as the endorser shaft 61 rotates, the endorsing die 30 rotates with it. The endorsing die 30 and its relative positioning and method of coupling will be discussed later.

Figure 2:
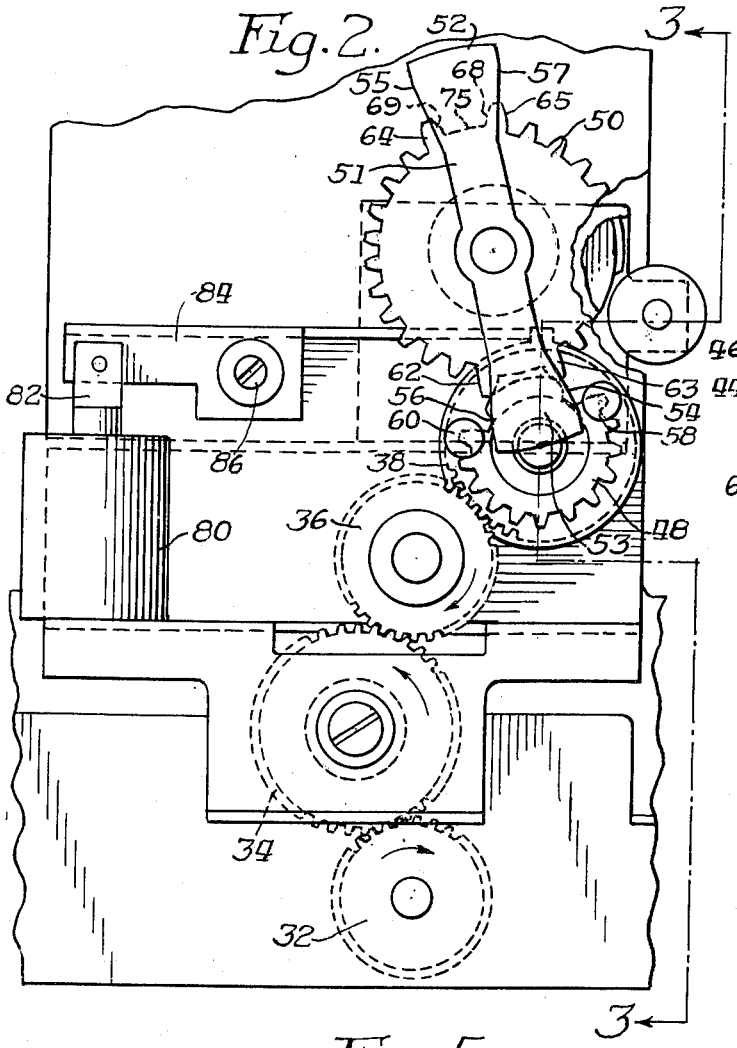
FIG. 2 is a side elevation view of the endorser of FIG. 1 with portions thereof removed for clarity.

FIG. 2 illustrates the gear train used in the inventive endorser. A drive gear 32 is connected to the driving motor (not illustrated). Drive gear 32 meshes with an upper transport transfer idler 34 which in turn drives an upper transport drive gear 36. The upper transport drive gear 36 in turn drives a clutch driving gear 38 having a central bore 39 which receives shaft 37. Therefore, as long as the motor drives the gear 32, the clutch driving gear 38 also rotates at a speed proportional to the gear train, 32, 34, 36, and 38.

The shaft 37 does not rotate as it is fixed to frame 11 of the endorser 10. The clutch drive gear 38 is allowed to rotate freely about shaft 37. A spring wrapped clutch 40 is used to provide an intermittent output to the endorser shaft 61.

The clutch 40 comprises a driving plate 42, a driven plate 44 and a spring 46. The driving plate 42 has a detent 45 extending in the form of a protrusion from one portion of the circumference of the driving plate 42. As long as there is a means to restrain the detent 45, the driving plate 42 is held in a stationary position and not allowed to rotate. No rotative movement is thus transferred to the driven plate 44. The clutch driving gear 38 continues to rotate but the spring wrapped clutch 40 does not allow a rotative output as long as the detent 45 is restrained. The driving plate 42 is in a slipping mode wherein it slips on spring 46 and against the side walls of the clutch driving gear 38 until detent 45 is released.

When the detent 45 is released, the driving plate 42 and driven plate 44 are allowed to rotate with the clutch driving gear 38.

Figure 3:
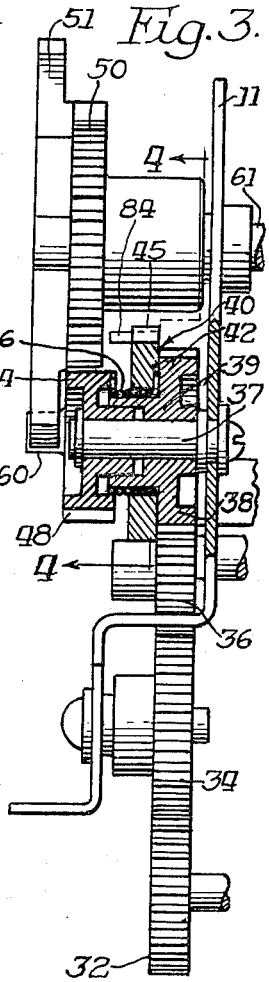
FIG. 3 is a view taken along line 3—3 of FIG. 2 with portions of the drive system removed for clarity.

Attached to driven plate 44 is a drive gear 48 more clearly illustrated in FIG. 3. One end of the spring 46 is locked in a groove in the driven plate 44 and therefore neither plate 44 nor gear 48 can rotate until detent 45 is released at which time all three pieces, 42, 44 and 48 rotate together. The drive gear 48 meshes with a driven gear 50 having an elongated cam 51 mounted on one end of the endorser shaft 61. The driven gear 50 and cam 51 are fastened together or affixed to the endorser shaft 61 such that they rotate together as one unit.

The cam 51 has opposite cam ends 52 and 53. Each end 52, 53 has respectively accelerating and decelerating surfaces 54, 55 and 56, 57 (FIG. 2). Mounted on the drive gear 48 are two pins, an accelerating pin 58 and a decelerating pin 60. Between the two pins 58 and 60 there is a smooth locking surface 76 which substantially follows the pitch diameter of the drive gear 48.

The driven gear 50 has two sets of oversize teeth 62, 63, 64, 65 having interior teeth wall portions 66, 67 and 68, 69 respectively. Between oversized teeth 62 and 63 there is a smooth driven gear toothless portion 74 and between oversized teeth 64 and 65 is a similar toothless portion 75.

Figure 6:
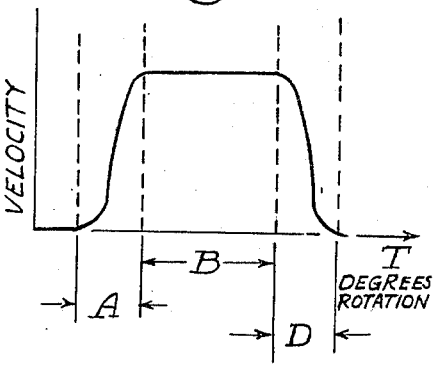
FIG. 6 is a graphic representation of the output of the system on the basis of velocity versus rotation of the output shaft.

It is intended to provide a gradual smooth acceleration of the endorsing die 30, followed by a constant driven speed of the endorser during the document endorsement, and then a smooth gradual deceleration until the endorsing die is stopped. This is graphically depicted in FIG. 6 wherein the horizontal axis represents the degrees rotation of the endorsing shaft from starting to stopping, and the vertical axis represents the velocity, V, of the endorsing shaft. The portion of the curve represented as A illustrates a smooth acceleration to a predetermined velocity. In operation it was found that the predetemined or endorsing velocity was reached in approximately 22° rotation of the endorsing shaft. The portion designated as B of the curve represents the constant rotational velocity of the endorser during the endorsing of the document. This was found to be approximately 136° rotation of the shaft. The portion of the curve represented by D is the smooth deceleration of the endorsing die to a stopped position. This was found to be approximately 22° rotation of the shaft completing the 180° endorsing cycle. The velocity of the endorser during endorsement should be essentially equal to the speed of the document as it passes through the endorsing area so that there is little or no relative motion between the two at the point of printing. This results in an endorsement which is clear and not smeared.

The sequence of operation of the intermittent endorser is as follows: A document enters the paper channel 14 and trips an actuator arm to a switch 78. (FIG. 1) The signal from the switch 78 closes an electrical circuit which provides an electrical pulse to solenoid 80. This pulls down a plunger 82 into the solenoid 80. A lever arm 84 is connected to the plunger 82 at one end and pivoted about a pivot point 86 with its opposite end 87 locked against the detent 45 in a restraining relationship (FIG. 4). As the plunger 82 is lowered vertically a sufficient depth it releases the detent 45 allowing the driving plate 42 of the spring wrapped clutch 40 to rotate.

The gear arrangement was designed such that the drive gear 32 rotates in a clockwise direction (as seen in FIG. 1) which results in the driving plate 42 and driven plate 44 both rotating in a counterclockwise direction.

The curved surface of the accelerating pin 58 first contacts the accelerating surface 54 of the cam end 53.

Figure 5:
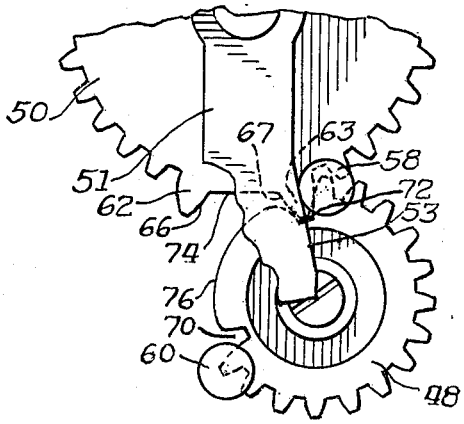
FIG. 5 is a side view of two locking surfaces in the drive system with portions of the gears removed for clarity.

The accelerating surface 54 was substantially flat with the resulting acceleration substantially identical to the smooth gradual acceleration of a Geneva wheel. Further rotation of the drive gear 48 results in engagement of the oversized tooth 63 with a recessed portion 72 on gear 48 (FIG. 5). At this point the endorser shaft 61 has been accelerated to the predetermined endorsing velocity due to the gradual acceleration as illustrated in the A portion of the curve of FIG. 6. The oversized tooth 63 and its associated recessed portion 72 form transition members so that the gear teeth of the drive gear 48 smoothly engage and mesh with the gear teeth of the driven gear 50. The teeth of the drive gear 48 continue to drive the driven gear 50 until the detent 45 on the driving plate 42 completes one revolution. As the switch 78 provides an intermittent pulse to the solenoid 80, the plunger 82 had been released allowing the opposite end 87 of the lever arm 84 to return to its normal position. Thus, as the detent 45 completes its revolution, it is once again retained and locked by the end 87.

Just before the detent 45 is stopped in its rotation, the decelerating surface 57 of the end 52 engages the curved surface of the decelerating pin 60. The decelerating surface 57 is substantially flat and of the same design as the accelerating surfaces. The decelerating sequence operates similar to the accelerating sequence and results in the portion D gradual deceleration, in the grap of FIG. 6.

The diameter of the drive gear 48 was 0.75 inches and the diameter of the driven gear 50 was 1.50 inches. Thus, a 2 to 1 ratio existed between the gears such that one complete revolution of drive gear 48 resulted in ½ revolution of driven gear 50. The alternate ends 52 and 53 of the cam 51 each acted identically in their operation with the drive gear 48 and pins 58 and 60.

As the ends 52 and 53 of the cam 51 have their respective decelerating surfaces contacting the decelerating pin 60, the geared tooth portion of the drive gear 48 disengages from the toothed portion of the driven gear 50. The locking surface 76 of the drive gear 48 restrains rotation of the driven gear 50 by means of the interior walls 66, 67 or 68, 69 contacting and locking with the smooth locking surface 76. As illustrated in FIG. 2, there is a slight gap between the smooth locking surface 76 and the toothless portion 74. In the position illustrated in FIG. 2, with the drive gear 48 locked in position by the detent 45, rotation of the driven gear 50 is not possible. This locking arrangement between the two gears eliminates any backlash or bounceback which might be caused by the detent 45 suddenly coming in contact and being stopped by the end 87 of lever arm 84, as the gear 50 and cam 51 have inertia which must be removed.

As previously stated, the endorser shaft 61 is directly connected to the driven gear 50 and since it is intermittently rotated in 180° movements, the endorser shaft 61 follows in 180° like movements. To utilize this half revolution movement, the endorsing die 30 is constructed with two endorsing plates 94 mounted on opposite sides of the endorsing die 30.

Figure 7:
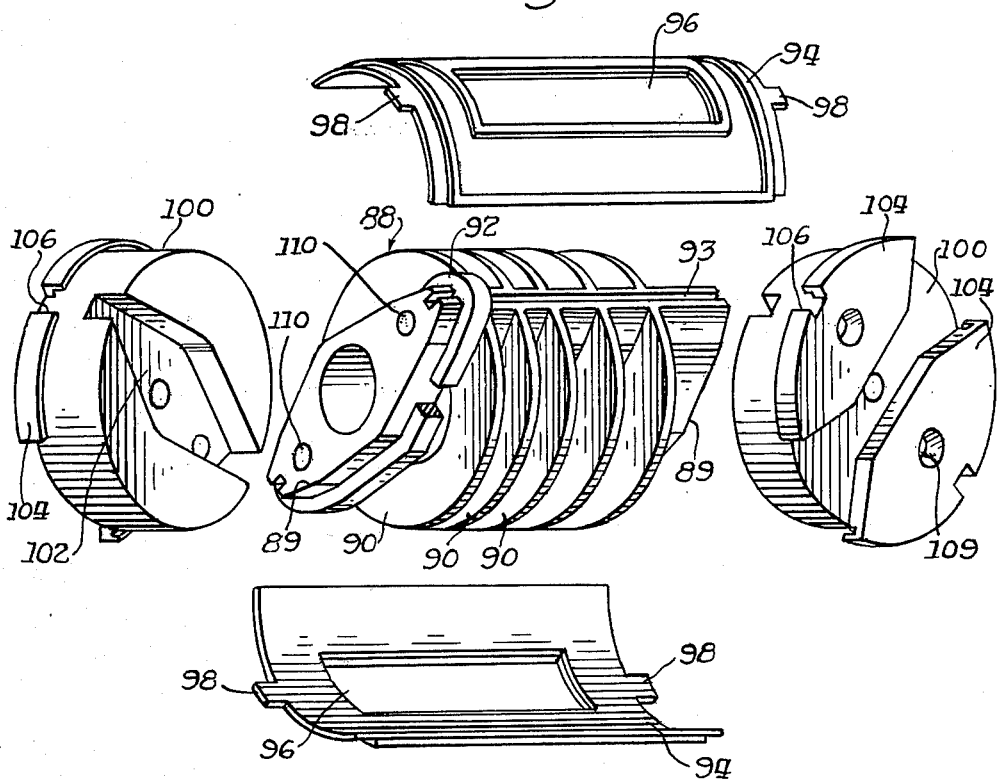
FIG. 7 is an exploded view in perspective of the endorsing die.

The endorsing die 30 is illustrated in its entirety in FIG. 7. A die cylinder 88 has opposite end portions 89. Between the end portions 89 are multiple circular discs 90. Between the discs are placed bands or tape 92 having alphanumeric or other designated symbols thereon. Generally, the bands 92 were manufactured of rubber or other expandable material which is stretched around the die cylinder 88 and between the discs 90. There are channels 93 at opposite sides of the die cylinder 88 which receive slight protrusions from the bands 92 to lock the bands in place.

The endorsing plates 94 have a window 96 through which the characters on the bands 92 extend. Generally, the endorsing plates 94 have additional printed material in the form of raised letters, the height of these raised letters being substantially identical to the height of the characters on the bands 92. This presents a substantially uniform printing surface height across the entire face of the endorsing plate 94 as it is rotated.

The plates 94 have end tabs 98 which are received in channel slots 106 on die cylinder caps 100 at either end of the die cylinder 88. There is a hollowed out portion 102 in the die cylinder caps 100 which receives the end portion 89 of the die cylinder 88. On the outermost portion of the die cylinder cap 100 are end plates 104 which have channel slots 106 therein. The channel slots 106 receive the end tabs 98 in locking relationship. A threaded fastener 108 enters passageway 109 in the end plates 104, which passageway extends through die cylinder cap 100. Passageway 109 is aligned with hole 110 in the end portion 89 of the die cylinder 88. Thus, the fasteners retain all the parts in a locked relationship.

Figure 8:
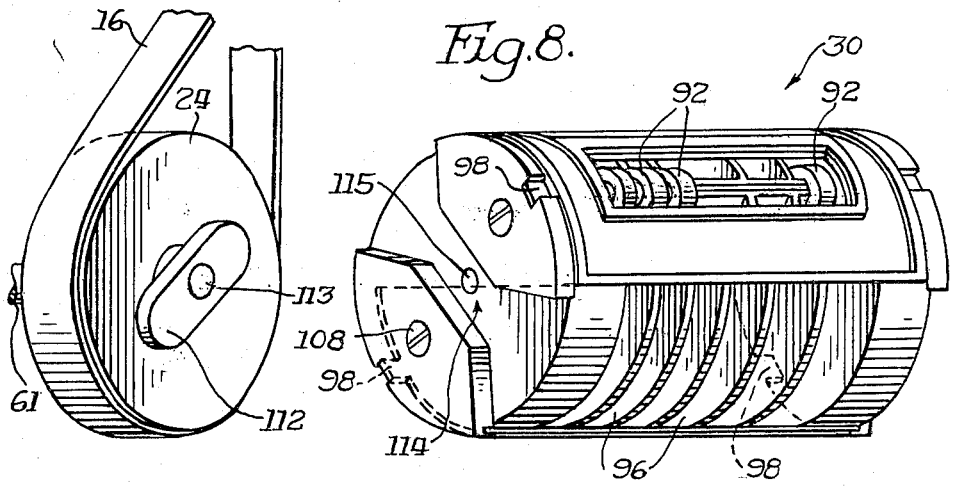
FIG. 8 is an exploded view of the endorsing die and a mating die shoe which rotates the endorsing die with portions thereof removed for clarity.

FIG. 8 illustrates the assembled die 30 and its method of coupling to the endorser shaft 61. As previously stated, the idler wheel 24 was allowed to freely rotate about shaft 61. A die shoe 112 is rigidly fastened to the end of the endorser shaft 61 on the inside portion of the idler wheel 24. A spring loaded ball bearing 113 is centrally located in the die shoe 112. A mating slot 114 formed at the end of the die cylinder 88 receives the die shoe 112. A circular indentation 115 receives the spring loaded ball bearing 113 and keeps the endorsing die from sliding out of engagement with the die shoe 112. A similar die shoe 112 and ball bearing 113 are located at the opposite end of the die cylinder 88. Thus, the endorsing die 30 is firmly locked in position for rotative movement, yet it can be removed by the user grasping the die 30 and overcoming the spring loaded ball bearing retainer.

FIG. 1 also shows an ink roller 116 which is placed in a spaced relationship to the endorsing die 30 whereby as the endorsing die 30 rotates the raised letter portions of the endorsing plate 94 and bands 92 receive ink from rolling in contact with the ink roller 116. Thus, with each rotation of the endorsing die 30 past the ink roller 116, a fresh supply of ink is placed on the printing portion for transfer to the document to be imprinted.

In the embodiment described above, the endorsing die 30 has two endorsing plates 94 positioned at opposite sides of the die cylinder 88. With each 360° revolution of the drive gear 48, the endorsing die 30 rotated 180°. It should be appreciated that the gearing arrangement can be adjusted such that for each revolution of the drive gear 48, the driven gear 50 would rotate for example 120° with the endorsing die 30 rotating the same amount. Thus, three die plates would be placed around the die cylinder 88. In order to maintain the nonlinear acceleration and deceleration there would have to be positioned on the driven gear 50 a cam 51 with three radially extending end portions such as 52, 53. The number of endorsing die plates are limited to the physical size of the die cylinder 88 and size of the individual endorsing plates 94. Also, sufficient rotation of the endorsing shaft must be allowed for the acceleration and deceleration time periods to bring the endorsing plate up to endorsing speed and to gradually stop it after endorsement.

The positioning of the endorsement on the document relative to the leading edge of the document which tripped the actuator arm of switch 78 can also be adjusted. One such method is to adjust upward the position of the actuator arm of switch 78. Thus, the document will move further through the endorsing area before the endorsing die rotates, causing imprinting of the document.

Thus it is apparent that there has been provided, an intermittent drive system that fully satisfies the objects, aims and advantages set forth above. While the invention has been described in conjunction with the specific embodiment of a rotary endorser, it is evident that many alternatives, modifications, and variations will be apparent to those skilled in the art in light of the foregoing description. Accordingly, it is intended to embrance all such alternatives, modifications, and variations as fall within the spirit and broad scope of the appended claims.

I claim:

1. A drive system for a document endorser comprising:

means to transport documents to be endorsed past an endorsing area at substantially a constant speed, an endorsing shaft with an endorsing die and an endorsing plate thereon, intermittent drive means with output means to supply power to rotate the endorsing shaft comprising:

a shaft on which is mounted the endorsing die, gear means to supply rotative power to the shaft and to maintain the speed of the endorsing die substantially constant during endorsement of the document, a latching disc having a detent restrained by a solenoid actuated lever arm mounted to restrain movement of the gear means, clutch means provided between the latching disc and gear means to provide an intermittent output, document sensing means positioned adjacent the document transport means and before the document endorsing area, the document sensing means activated by the passage of the document, and providing a signal to release the latching disc and clutch means allowing rotation of the shaft, and means to reset the latching disc to restrain further rotation of the shaft after endorsement of the documents until the latching disc is rereleased, means to accelerate the endorsing shaft and endorsing die from a stopped position until the speed of the endorsing plate is substantially equal to the speed of the document in the endorsing area, the means to accelerate causing the endorsing shaft to rotate at least 5° from its stopped position before the endorsing plate reaches the document speed in the endorsing area, means to place the endorsing plate in contact with the document in the endorsing area, means to decelerate the endorsing shaft and endorsing die after endorsing of the document, the means to decelerate causing the endorsing shaft to rotate at least 5° during deceleration from the document endorsing plate speed to its stopped position, the means to accelerate and decelerate comprising a cam and accelerating and decelerating rollers mounted on the same body for rotative movement relative to the cam, the cam mounted to the endorsing shaft and having opposite identical symetrical cam ends, each cam end having substantially flat accelerating and decelerating cam surfaces which are identical to each other, the accelerating roller operatively connected to the output means of the intermittent drive means for driving the accelerating cam surface, the decelerating roller operatively connected to the intermittent drive means for controlled stopping of the decelerating cam surface, the gear means comprising at least two meshing gears, one gear having a rounded toothless portion substantially following the pitch diameter of the gear, and the other gear having an oversized locking tooth mating with the rounded toothless portion, whereby the gears are rotatably locked relative to each other when the solenoid actuated lever arm restrains the disc from rotating, whereby the means to accelerate and decelerate the endorsing die result in reduced shock loading and quieter operation of the system.

2. An intermittent drive comprising:

an output shaft, a constantly rotating input drive gear, a cam mounted to the output shaft and having opposite identical symetrical cam ends, each cam end having substantially flat accelerating and decelerating cam surfaces which are identical to each other, a clutch input operatively connected to the input drive gear, a clutch output, means to allow the clutch output to provide an intermittent rotative output comprising:

latching disc means having a detent restrained by a solenoid actuated lever arm mounted to restrain the clutch output from rotating, means to reset the latching disc means to restrain further rotation of the clutch output after the deceleration of the output shaft, until the latching disc means are re-released, accelerating roller means provided between the clutch output and the output shaft to accelerate the cam and associated output shaft to a predetermined speed, the accelerating roller means causing the cam and associated output shaft to rotate at least 5° from its stopped position before the output shaft reaches the predetermined speed, gear means to maintain the speed of the output shaft constant for a predetermined time period comprising at least two meshing gears, one gear having a rounded toothless portion substantially following the pitch diameter of the gear, and the other gear having an oversized locking tooth mating with the rounded toothless portion, whereby the gears are rotatively locked relative to each other when the latching means restrain further rotation of the clutch output, decelerating roller means provided between the clutch output and the output shaft to decelerate the cam and associated output shaft after the predetermined time period, the decelerating roller means causing the cam and associated output shaft to rotate at least 5° during deceleration from the constant speed to its stopped position.

* * * * *